United States Patent [19]

Sacks

[11] 4,099,717

[45] Jul. 11, 1978

[54] ADJUSTABLE TENSION TENNIS RACKET

[76] Inventor: Bernard R. Sacks, 128 Commonwealth Rd., Cochituate, Mass. 01778

[21] Appl. No.: 795,995

[22] Filed: May 11, 1977

[51] Int. Cl.[2] ..... A63B 51/12

[52] U.S. Cl. ..... 273/73 E

[58] Field of Search ..... 273/73 R, 73 C, 73 D, 273/73 E, 73 G, 73 H

[56] References Cited

U.S. PATENT DOCUMENTS

| | | | |
|---|---|---|---|
| 1,663,039 | 3/1928 | Craven | 273/73 E |
| 2,089,118 | 8/1937 | Fritsch | 273/73 E |
| 2,206,548 | 7/1940 | Goerke | 273/73 E |
| 4,013,290 | 3/1977 | Stevens | 273/73 E |

FOREIGN PATENT DOCUMENTS

| | | | |
|---|---|---|---|
| 137,011 | 12/1919 | United Kingdom | 273/73 E |
| 234,021 | 5/1925 | United Kingdom | 273/73 E |

*Primary Examiner*—Richard J. Apley

*Attorney, Agent, or Firm*—James J. Cannon, Jr.

[57] ABSTRACT

A game racket with adustable string tension including a vertically movable tension bar positioned between the throat and handle sections, perpendicular to the plane of the racket, which engages directly to a loop extending below a main string retaining bar by an integral hook. The position of the tension bar and consequently the string tension are varied by rotating an interconnecting tension ring which traverses parallel threaded sections of the outer surfaces of the neck, and which is maintained at particular position by an abutting locking ring.

1 Claim, 4 Drawing Figures

ADJUSTABLE TENSION TENNIS RACKET

BACKGROUND OF THE INVENTION

1. Field of the Invention

The invention pertains to the field of game rackets having a selfcontained means of adjusting string tension.

2. Description of the Prior Art

The most commonly used method of adjusting string tension in game rackets as to vary the position of a movable yoke in the racket throat to which the main longitudinal strings are attached. This concept was established by British Pat. Nos. 28,838, and was developed further in U.S. Pat. Nos. 3,625,512 and 3,664,669. A major shortcoming to such an approach is that replacement of a fixed yoke by a movable one reduces the mechanical integrity and stability of the frame. U.S. Pat. No. 3,990,700 introduces a radical modification to the shape of the movable yoke to counteract a buckling tendency thus produced and to prevent a floppy feeling when the racket strikes a ball.

An additional drawback of prior inventions is undesirable weight in the handle portion, away from the center of gravity, which affects the overall balance and playability of the racket. For example, the tensioning rod used in U.S. Pat. No. 3,990,700 extends to the very end of the handle, and requires supporting hardware in the handle area as well.

SUMMARY OF THE INVENTION

The object of this invention is to provide a quickly and easily adjustable method for varying and maintaining the tension of both the main and cross strings of a game racket, using a mechanism having relatively few moving parts and adding relatively little weight, thereby preserving the proper weight and balance characteristics of the basic racket.

The adjustable tension racket of this invention includes a frame having a handle portion for gripping by a player, a head portion for supporting the racket strings, an open throat portion between the head and the handle to accomodate a fixed yoke for supporting the main strings and functioning as a support member for the frame, a main string retaining bar, and a tension bar assembly which directly engages a loop below the main string retaining bar and varies the tension on same by being displaced through a continuous series of positions along a brief segment of the neck portion. The tension bar assembly includes an aluminum tension bar situated in the open throat area perpendicular to the plane of the racket and a tension ring for moving said tension bar. An integral component of the tension bar is a stainless steel hook which is coplanar with the bar and extends upward toward the head. Said hook engages into a loop formed under the main string retaining bar, which is located below the fixed yoke. On either end of said tension bar is a pad of graphite or other material which rides on a track cut into the inner circumference of an aluminum tension ring. The width of this track is less than the thickness of said ring, and the remaining portions of the inner circumference are threaded. This threaded inner circumference tightly engages a similarly threaded section of the outer surface of the tubular metal frame, permitting the tension ring and the interconnected tension bar to be moved in a vertical direction along the throat of the racket by rotating the tension ring. The position of said tension ring is maintained by a locking ring of similar size and construction which is situated immediately above the tension ring on the same threaded portion of the frame and which is drawn uptight against the tension ring to prevent rotation to a position closer to the head.

As a practical matter the simplicity of the invention permits ease of fabrication and assembly and relatively little expense added to that of the basic racket design. Fewer manufacturing steps are needed because of no modifications to the handle.

DESCRIPTION OF THE PREFERRED EMBODIMENT

Figure 1:
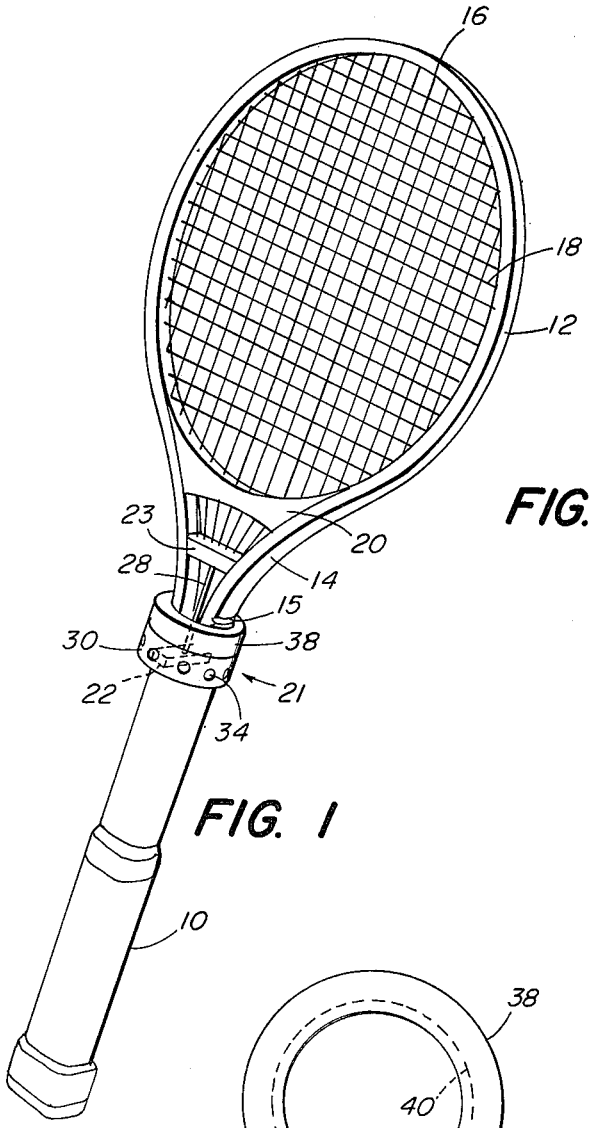
FIG. 1 is a perspective view of an exemplary embodiment of the invention.

With reference now to the drawings and more particularly to FIG. 1 thereof, there is shown a perspective view of an embodiment of the invention. The frame is typically a double hollow aluminum extrusion bent into a racket shape as shown, having a handle portion 10, a head portion 12 and an open throat portion 14 between the head 12 and the handle 10. The head portion 12 is designated as the top of the racket and the handle portion 10 is a means for supporting the main strings such as 16 and the cross strings such as 18. The throat portion 14 accomodates fixed yoke 20 through which the bottom ends of main strings 16 are positioned.

This invention pertains to a novel means for adjusting the tension of the main strings 16 and the cross strings 18. To achieve this purpose an adjustable tension bar assembly 21 is secured near the base of the throat portion 14. This assembly includes a tension bar 22 (shown in FIG. 2 and described hereinafter) situated in the open throat portion 14 and being perpendicular to the plane of the racket, and a main string retaining bar 23 positioned in throat 14 below yoke 20. Main string retaining bar 23 receives the looped ends of main strings 16 through holes 25. Retaining bar 23 has graphite ends 27 to permit easy vertical movement in throat 14. An integral component of tension bar 22 is a hook 28 which is coplanar with tension bar 22 and extends vertically upward towards the head portion 12 of the racket. Hook 28 engages an eye 29 in the main string retaining bar 23, which eye 29 extends below said retaining bar 23.

Tension bar assembly 21 further includes a tension ring 30 which is used to secure tension bar 22 in position and to permit tension bar 22 to move in a vertical direction. With reference again to FIG. 1 in conjunction with FIGS. 2 and 3, tension ring 30 encircles the throat portion 14, tightly engaging the straight, threaded section 15 of the frame by means of threads 32 and 33 which are cut into the portions of the inner circumference which were unaffected by the fabrication of track 36 which retains tension bar 22. Rotating tension ring 30 counterclockwise as viewed from the bottom moves said ring downward, carrying the interconnected tension bar 22 and main string retaining bar 23 along with it, thereby increasing the tension on the main strings 16. Said ring is rotated by a wrench which is inserted into several of a series of circular holes 34 cut into the outer circumference. Tension bar 22 has graphite pads 24 and 26 at each end (FIG. 2) which slide along the track 36 as tension ring 30 is rotated, thus permitting tension bar 22 to maintain its spatial orientation perpendicular to the frame. The increased tension on main strings 16 causes the head portion 12 to become shorter and wider, thereby increasing the tension on cross strings 14 as well.

Once tension ring 30 has been rotated to the desired position, it is maintained there by a lock ring 38, a top view of which is shown in FIG. 5. Said lock ring 38 also encircles the throat portion 14, directly above tension ring 30, similarly engaging threaded section 15 by means of threads 40 on its inner circumference. Rotating said lock ring 38 until it stops against the tension ring 30 prevents any upward movement of the tension ring 30.

Figure 2:
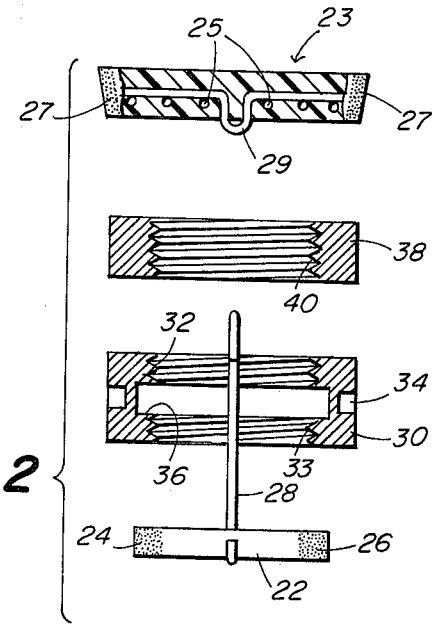
FIG. 2 is an exploded cross-sectional view of the tension bar assembly.
Figure 4:
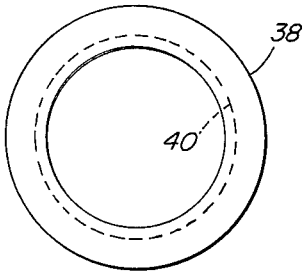
FIG. 4 is a top view of the lock ring.

FIG. 2 is an exploded view of the tension bar assembly 21 and main string retaining bar 23 showing all components in a cross-sectional view.

Figure 3:
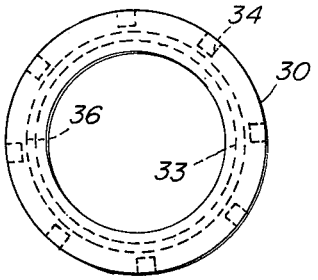
FIG. 3 is a top view of the tension ring.

FIG. 3 shows a top view of said tension ring 30. Track 36, cut and recessed into the inner circumference, is the surface upon which the said graphite pads 24 and 26 of tension bar 22 ride.

Three distinct advantages over prior art are offered by this embodiment of the invention. First, only three lightweight aluminum parts situated relatively close to the center of gravity are required to perform the tensioning function, so that neither the weight nor balance of the racket is adversely affected. Second, an integral fixed yoke is used which provides mechanical stability to the frame to prevent buckling and twisting. Third, the handle portion remains untouched, eliminating extra fabricating steps and an undesirable distribution of weight.

I claim:

1. A game racket apparatus wherein said racket includes a head portion for carrying main and cross strings, an open throat portion, a fixed yoke in said open throat portion, a handle portion for gripping by the player and having means for adjusting string tension comprising:

a threaded segment machined in the outer surfaces of said throat portion of the racket;

a tension ring, threaded on a portion of its inner circumferential surface, encircling and engaging said threaded segment of the outside of said throat portion, and being adjustable along the vertical length of the threaded segment of said throat by rotating said tension ring;

a recessed track, cut into the unthreaded portion of the inner circumferential surface of said tension ring;

a tension bar situated in said open throat portion perpendicular to the plane of said racket;

said tension bar having at its ends graphite pads which engage said recessed track;

said tension bar being able to slide freely on the recessed track of said tension ring, to maintain its spatial orientation perpendicular to the plane of said racket and simultaneously to move in a vertical direction along the threaded length of said throat, depending on the direction of the rotation of said tension ring;

an upwardly extending hook integrally formed and coplanar with said tension bar;

a main string retaining bar situated in said throat which receives the looped ends of said main strings and which is capable of vertical movement within the throat area between said yoke and said tension bar;

a downwardly extending eye, integrally formed with said main string retaining bar, which engages said upwardly extending hook;

a threaded locking ring which engages said threaded segment of the throat portion directly above said tension ring and is rotated until it comes into direct contact with said tension ring to lock said tension ring in position;

a plurality of notches cut into the exterior circumferential surface of said tension ring to permit its rotation by a wrench;

a rotation of said tension ring resulting in a vertical movement of said tension bar and said main string retaining bar, resulting in a change in tension on said strings.

* * * * *